US005941630A

United States Patent [19]

Finke et al.

[11] Patent Number: 5,941,630

[45] Date of Patent: Aug. 24, 1999

[54] LIGHT SOCKET LOCKING MECHANISM

[75] Inventors: Ralph Finke, Guethersloh; Frank Evertzberg, Marienfeld; Norbert Hülsewiede, Lippstadt, all of Germany

[73] Assignee: Steinel GmbH & Co. Kg., Germany

[21] Appl. No.: 08/909,226

[22] Filed: Aug. 11, 1997

[51] Int. Cl.[6] ..... F21P 5/00

[52] U.S. Cl. ..... 362/371; 362/287; 362/427

[58] Field of Search ..... 362/147, 287, 362/288, 370, 371, 418, 427, 428, 419, 421, 422, 425; 403/76, 93, 99, 111, 144, 164, 166

[56] References Cited

U.S. PATENT DOCUMENTS 5,649,761 7/1997 Sandell et al. ..... 362/276
5,788,518 8/1998 Wachter et al. ..... 439/121

*Primary Examiner*—Cassandra Spyrou
*Assistant Examiner*—Craig Curtis
*Attorney, Agent, or Firm*—Kinney & Lange, P.A.

[57] ABSTRACT

A self-locking adjustable light fixture comprising an arm, a base, a hood, an arm securing mechanism, and a hood securing mechanism. The arm has an annular shape with interconnecting protrusions at a proximal end and a distal end. The base has mating interconnecting notches that are axially aligned with the interconnecting protrusions of the proximal end of the arm. The base is connected to the proximal end of the arm by the arm securing mechanism which biases the interconnecting protrusions at the proximal end of the arm with the mating interconnecting notches of the base to prevent rotation of the arm. The hood has mating interconnecting notches aligned with the interconnecting protrusions at the distal end of the arm. The hood is connected to the distal end of the arm by the hood securing mechanism which biases the interconnecting protrusions at the distal end of the arm into the mating interconnecting notches of the hood to prevent rotation of the hood with respect to the arm. The bias between the hood and the arm and the arm and the base is capable of being overcome by tension to separate the interconnecting protrusion from the mating interconnecting notches and allow rotation of the arm with respect to we base and rotation of the hood with respect to the arm for the proper positioning of light from the light fixture.

16 Claims, 10 Drawing Sheets

LIGHT SOCKET LOCKING MECHANISM

BACKGROUND OF THE INVENTION

This invention pertains to a light fixture. More particularly, it pertains to a self-locking, adjustable light fixture.

Use of light fixtures is an effective and popular choice to deter unwanted activity and increase the security of commercial or private property. Motion detector security lights are particularly effective for this purpose. However, to be effective the light must be positioned to cover hidden or darkened areas.

In order to direct light at a desired area, various light fixture designs have been employed that utilize a set screw, or a tension line in conjunction with a ball and socket. These designs generally attempt to secure an arm which extends from a base of the light fixture and has a socket to hold a light bulb in a desired position to properly direct the light. Passage of time and exposure to the elements however, tends to alter or change the positioning of the arm, and hence the socket holding the light bulb. To obtain the desired coverage of light again, the arm will have to be readjusted provided exposure has not ruined the positioning mechanism.

Either initially adjusting or later correcting the arm's position is difficult utilizing the known designs. The set screw design requires use of additional tools to secure the arm in place once it is properly positioned. However, the set screw is generally located in a position that is not readily accessible, which further complicates the adjustment process. This requires the installer to hold the arm in place with one hand while using the other hand to tighten down the screw which holds the arm in place.

Often the position of the arm socket changes while the set screw is being tightened, which requires the whole process to begin anew. Additionally, once the set screw is tightened and the arm is properly positioned, exposure to the elements can cause corrosion and rust to form in the set screw mechanism which leads to an undesired repositioning of the arm or makes future adjustments difficult, if not impossible.

Use of a tension line in conjunction with a ball and socket joint between the arm and the base also creates its own set of problems. The passage of time and exposure to the elements will eventually deteriorate the elasticity of the tension line. As a result, the tension line will no longer be able to secure the socket in its properly adjusted position. Furthermore, exposure to the elements such as wind, rain, snow or hail may cause undesired repositioning of the arm and misdirect the light. Overcoming these defects requires either that the tension line be replaced or an external structure be incorporated to secure or shield the arm in its proper location. These additional maintenance measures make these types of devices difficult to work with and unreliable over time.

There is therefore, no known security light that enables adjusting the arm of the light fixture to maintain a desired position and direction of light that is easy to use, self-locking and reliable.

SUMMARY OF THE INVENTION

The present invention is a self-locking, adjustable light fixture comprising an arm, a base, a hood and a securing mechanism. The arm is annular in shape and has a distal end and a proximal end. A series of interconnecting means are located on the distal end and the proximal end of the arm. The base connects to the proximal end of the arm and has mating interconnecting means which are axially aligned and receive the interconnecting means located on the proximal end of the arm. The hood connects with the distal end of the arm and has mating interconnecting means which are axially aligned and receive the interconnecting means located on the distal end of the arm. A securing mechanism connects the base with the proximal end of the arm and the hood with the distal end of the arm, such that the interconnecting means and the mating interconnecting means are biased together to prevent rotation. The bias between the base and the arm as well as the arm and the hood can be overcome by tension which allows rotation of the arm or hood to adjust the direction of the light as desired.

DETAILED DESCRIPTION OF THE PREFERRED EMBODIMENTS

Figure 1:
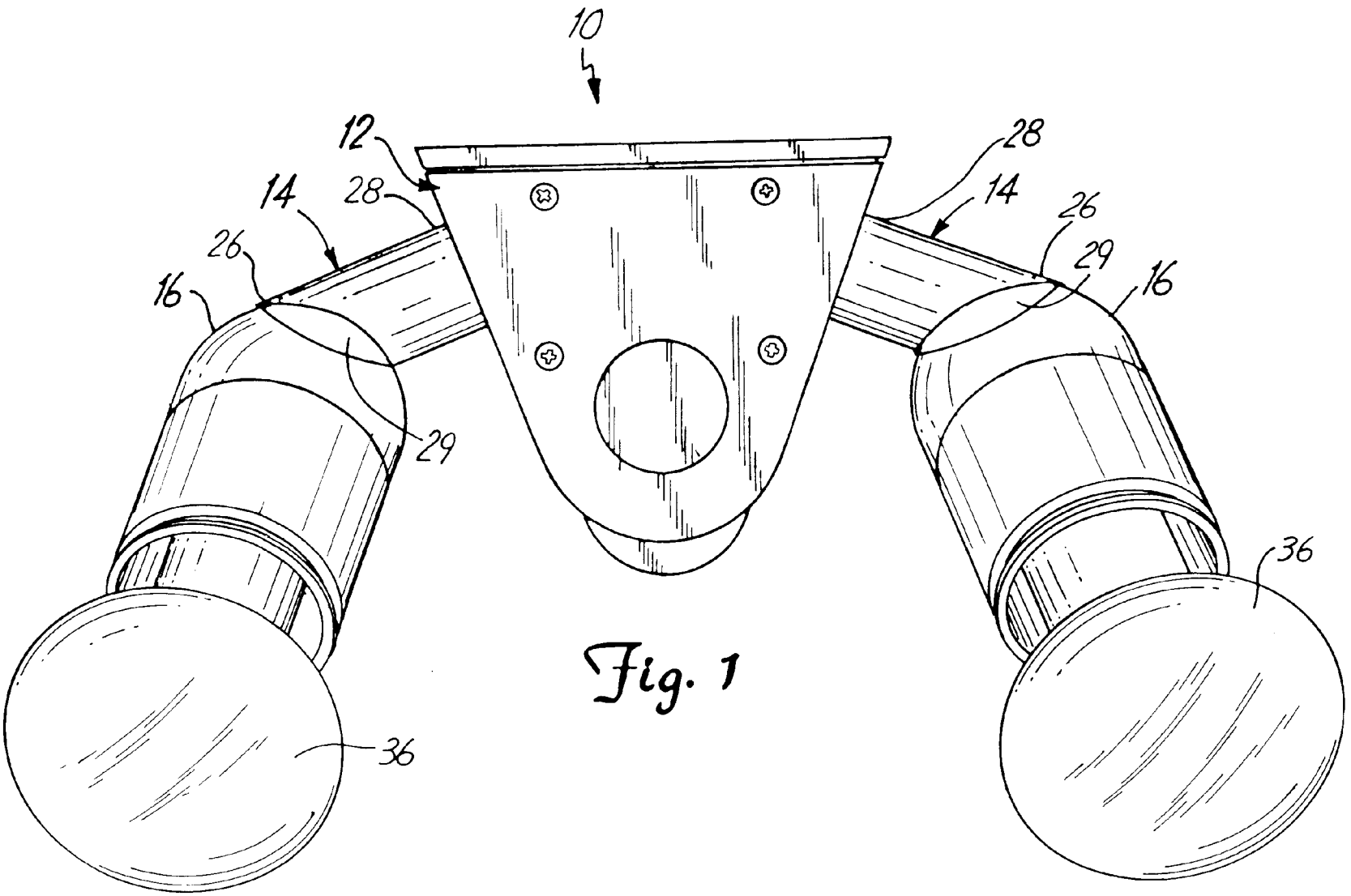
FIG. 1 is a top view of a preferred embodiment of the claimed invention.

In FIG. 1, a preferred embodiment of a self-locking adjustable light fixture 10 is shown. The self-locking adjustable light fixture 10 is comprised of base 12, arms 14, hoods 16 and securing mechanism 18.

In a preferred embodiment, arms 14 extend from and are interconnected with base 12. Arm 14 is preferably annular in shape and has distal end 26 and proximal end 28. Proximal end 28 is connected to base 12 and distal end 26 is connected to hood 16.

Circular member 29 extends from distal end 26 of arm 14 along a different annular axis than the rest of arm 14. The outer surface of circular member 29 conforms with the outer surface of hood 16 to form a generally smooth continuous outer surface at the interconnection of hood 16 and arm 14.

Hood 16 contains a socket to secure light bulb 36 which when powered by fixture 10 provides light in the direction that hood 16 is aimed. Securing mechanism 18 exists at each of the interconnections between base 12 and arm 14, as well as between arm 14 and hood 16.

As shown in FIGS. 2–5, self-locking adjustable light fixture 10 allows for adjustment or rotation about two distinct axes for each combination of hoods 16 with arms 14 and base 12. The point of rotation about the two distinct axes are located at the interconnection between base 12 and arm 14, and between arm 14 and hood 16. By adjusting or rotating arm 14 with respect to base 12 and hood 16 with respect to arm 14, light from light fixture 10 can be directed to a desired location.

FIGS. 2–5 also provide a more detailed view of the interconnection between base 12 and arms 14. Base 12 further includes outer wall 20, through holes 25 and sensor 27. Through holes 25 are located in outer wall 20 of base 12 and interconnect proximal ends 28 of arms 14 with base 12. Sensor 27 is placed in the front of base 12 to detect motion which activates fixture 10. Proximal ends 28 of arms 14 further include first flanges 30 which abut outer wall 20 at the interconnection of arms 14 and base 12.

Figure 2:
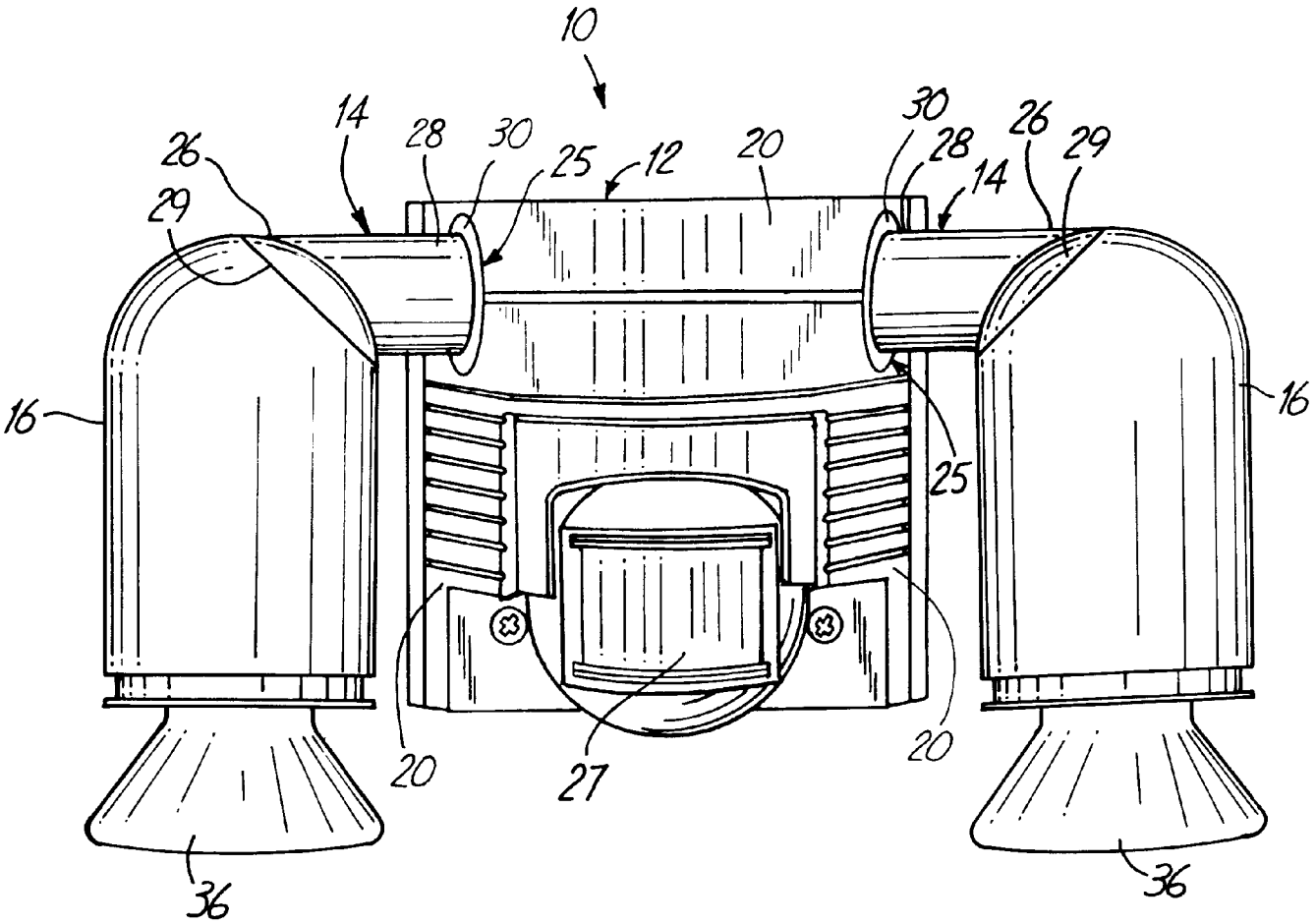
FIG. 2 is a front view of a preferred embodiment of the invention directing light to a first position.

With respect to directing light from light fixture 10, FIG. 2 shows hoods 16 aimed perpendicular to arms 14, or straight down from light fixture 10. By overcoming the bias at the interconnection between arms 14 and base 12, arms 14 can be rotated with respect to base 12 about the longitudinal axis of arms 14.

Figure 3:
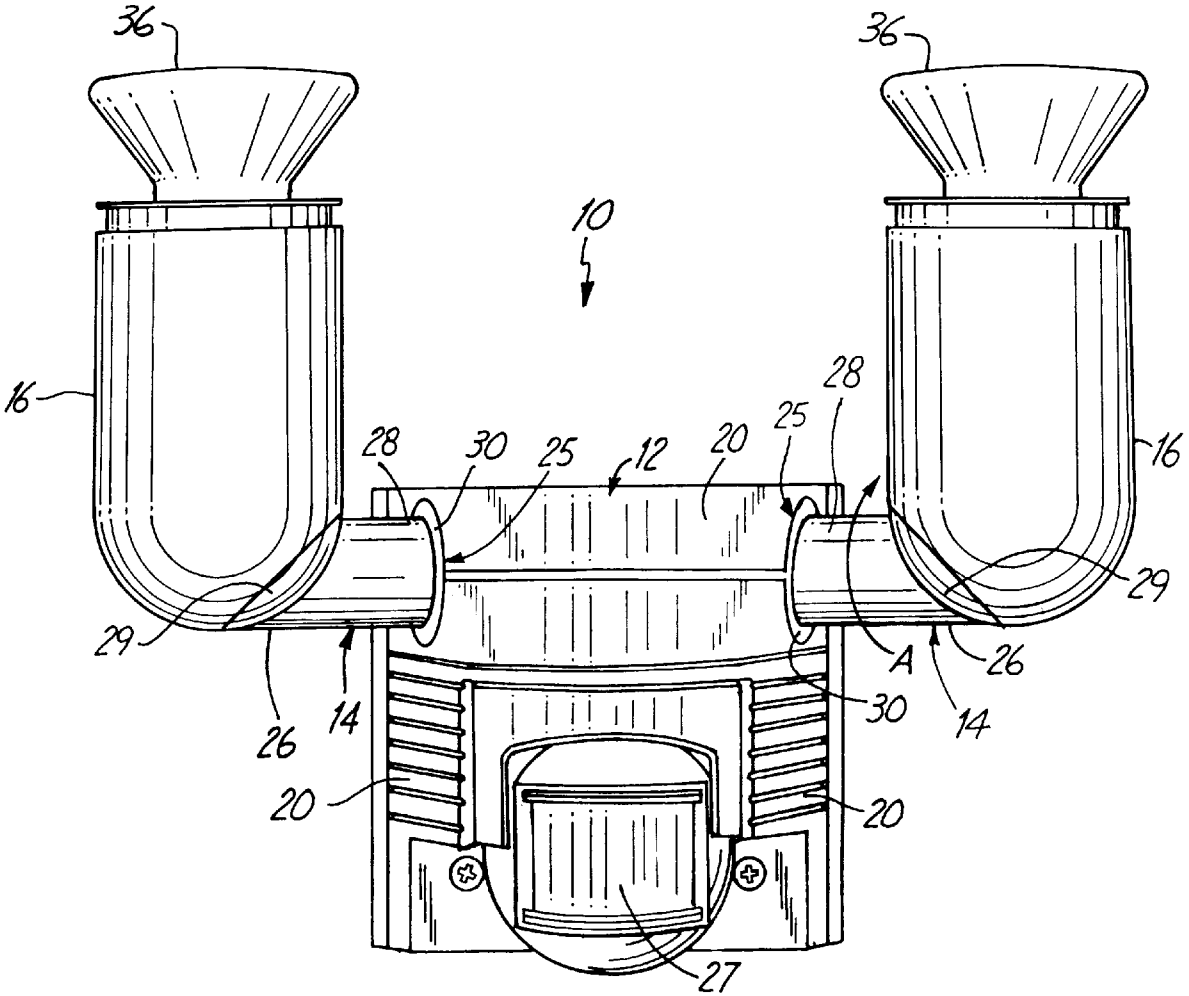
FIG. 3 is a front view of a preferred embodiment of the invention directing light to a second position.

FIG. 3 shows rotation of arms 14 with respect to base 12, in comparison with FIG. 2. In FIG. 3, arms 14 have been rotated with respect to base 12 by 180° in the direction of arrow A from their position in FIG. 2. Rotation of arms 14 with respect to base 12 about the longitudinal axis of arms 14 does not alter the position of hoods 16 with respect to the arm 14. This is illustrated in FIG. 3 by hoods 16 maintaining a perpendicular relationship with respect to arms 14. However, the 180° rotation of arms 14 with respect to base 12 about the longitudinal axis of arms 14 correspondingly redirects light from light fixture 10 in FIG. 3 180°, or straight up, as compared with FIG. 2.

Figure 4:
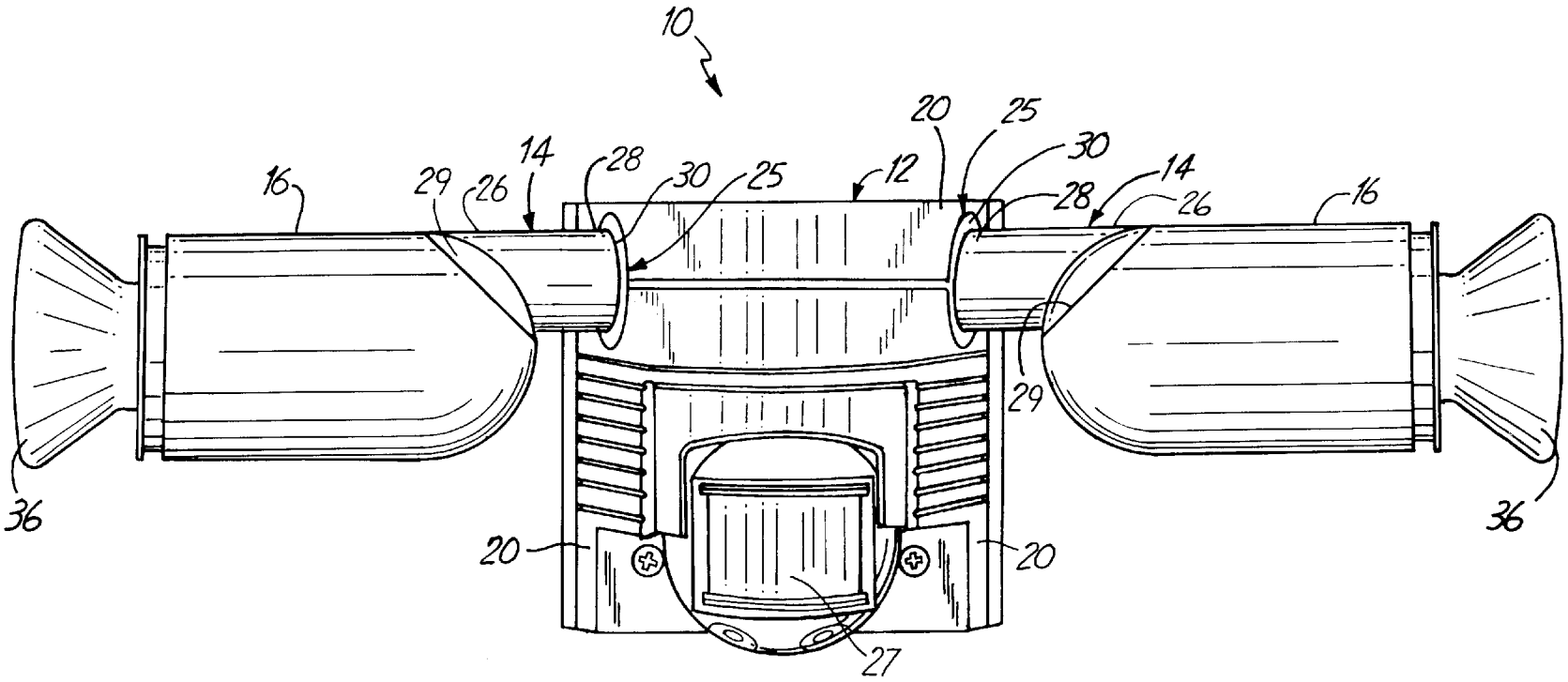
FIG. 4 is a front view of a preferred embodiment of the invention directing light to a third position.

FIG. 4 shows hoods 16 pointed straight out from arms 14 or perpendicular to the body of base 12. By overcoming the bias of the interconnection between hoods 16 and arms 14, hoods 16 can be rotated with respect to arms 14 to redirect light from light fixture 10. Rotation of hoods 16 with respect to arms 14 is illustrated by comparison of FIGS. 4 and 5.

Figure 5:
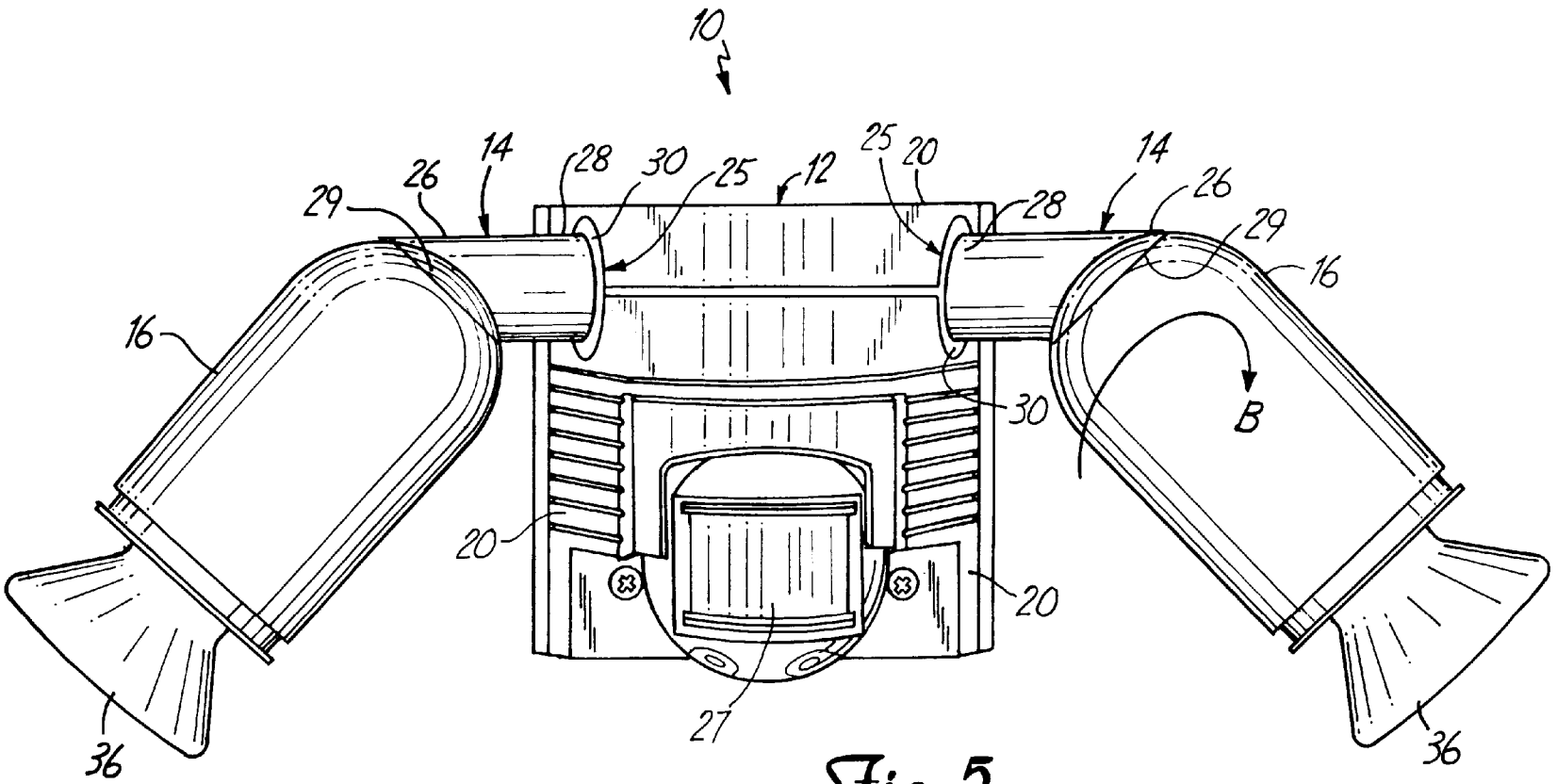
FIG. 5 is a front view of a preferred embodiment of the invention directing light to a fourth position.

In FIG. 5, hoods 16 have been rotated approximately 45° with respect to arms 14 from their positions in FIG. 4 in the direction of arrow B. This results in redirecting the light from light fixture 10 downwardly or at a 45° angle with respect to arms 14. Rotation of hoods 16 with respect to arms 14 does not alter the position of arms 14 with respect to base 12 as illustrated in FIGS. 4 and 5.

In each of FIGS. 1–5, the left and right pair of arms 14 and hoods 16 are shown in approximately the same position with respect to the other. However, securing mechanism 18 is located at each of the interconnections and is separate and independent from the others. This allows independent rotation and redirecting of light for each hood 16 and arm 14.

Figure 6A:
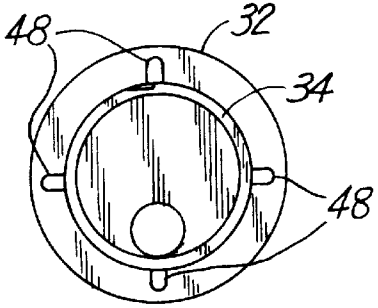
FIG. 6A is an end view of a proximal end of an arm.
Figure 6:
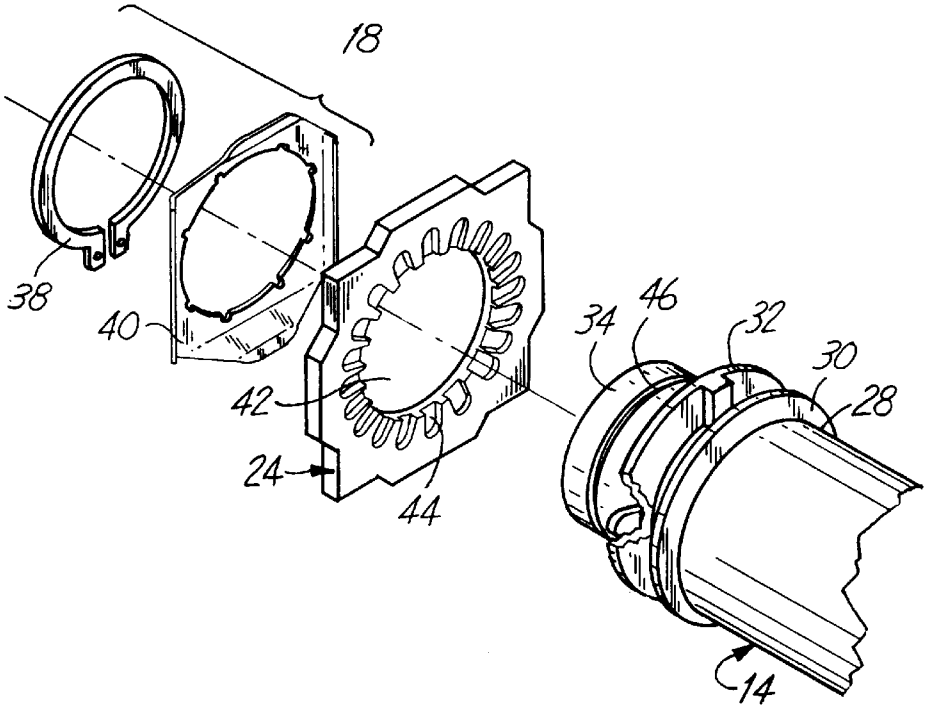
FIG. 6 is a partial exploded perspective view of the interconnection between a proximal end of an arm and a base.

FIG. 6 shows a portion of the interconnection between arm 14 and base 12 that is secured by the securing mechanism 18 in an exploded view. In FIG. 6, base 12 is represented by plate 24, which is preferably a separable piece of base 12. Plate 24 has a hole 42 and a continuous ring of notches 44 formed around the circumference of hole 42.

Additionally, first flange 30 of arm 14 is also more clearly shown. Arm 14 further includes second flange 32, axle 34, and groove 46. In a preferred embodiment, axle 34 passes through hole 42 of plate 24, which allows second flange 32 to abut with plate 24. A series of protrusions 48 are radially aligned and extend from the face of the second flange 32 which abuts with plate 24. Protrusions 48 are aligned and mate with notches 44 of plate 24 to form the interconnecting means between arm 14 and base 12. Protrusions 48 are more clearly shown in FIG. 6A which is an end view of proximal end 28 of arm 14.

In a preferred embodiment, the series of protrusions 48 are a set of four solid U-shaped figures with side edges that are perpendicular to the face of second flange 32 that abuts with plate 24. Correspondingly, notches 44 formed around hole 42 of plate 24 are also U-shaped to receive protrusions 48. The solid U-shaped design helps prevent any accidental adjustment or rotation of arm 14 with respect to base 12, especially during adjustment of hood 16 with respect to arm 14.

Axle 34 also passes through spring 40 of the securing mechanism 18. Once plate 24 and spring 40 are placed on axle 34, retaining clip 38 is secured in groove 46. This secures plate 24 and spring 40 on axle 34 between second flange 32 and retaining clip 38.

Figure 7:
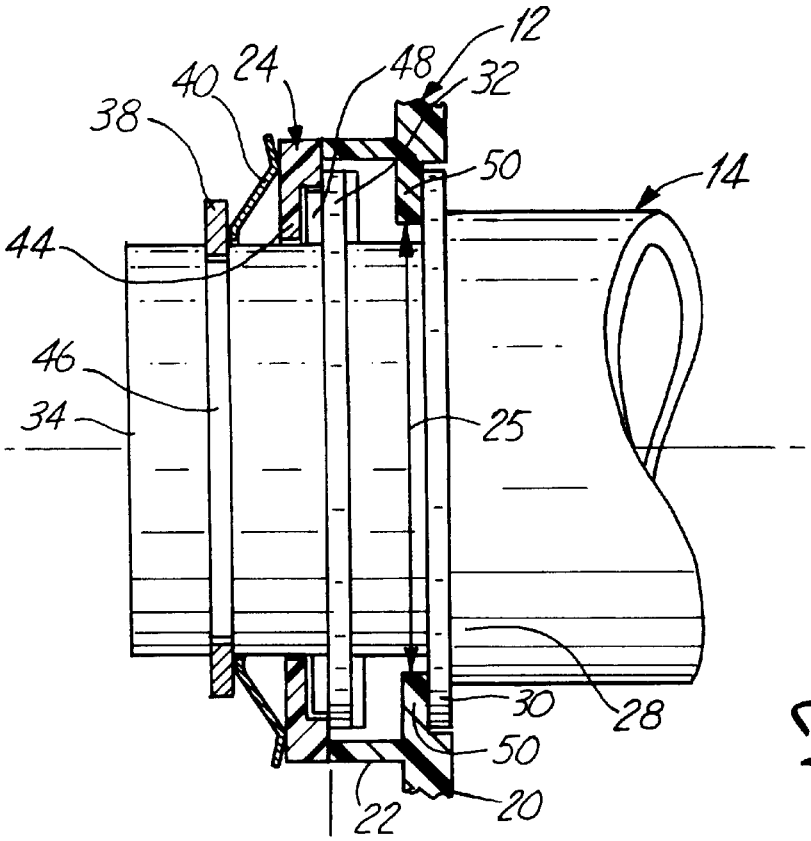
FIG. 7 is a partial cross-sectional view of a preferred embodiment of the invention showing a proximal end of an arm connected to a portion of a base in an unflexed state.

In FIG. 7, a partial cross-sectional view of a preferred embodiment of the interconnection between base 12 and arm 14 that is maintained by securing mechanism 18 is shown in an unflexed state. Axle 34 is cradled in through hole 25 in outer wall 20 of base 12. In a preferred embodiment, axle 34 and through hole 25 are approximately equal in diameter to keep moisture and debris out of light fixture 10. With axle 34 cradled in through hole 25, plate 24 maintains its position against inner wall 22 of base 12 causing spring 40 to compress against retaining clip 38 secured in groove 46 biasing first flange 30 and second flange 32 against outer wall 20 and plate 24, respectively. In a preferred embodiment, recess 50 is formed in outer wall 20 to receive first flange 30 and act as a stop as well as help keep moisture and debris from building up at the interconnection of arm 14 and base 12 and entering light fixture 10.

In addition to first flange 30 and second flange 32 abutting outer wall 20 and plate 24 in an unflexed state respectively, protrusions 48 are received by or mate with corresponding notches 44 in plate 24. This maintains the position of arm 14 with respect to base 12 and prevents rotation of arm 14 with respect to base 12 about the longitudinal axis of arm 14.

Figure 8:
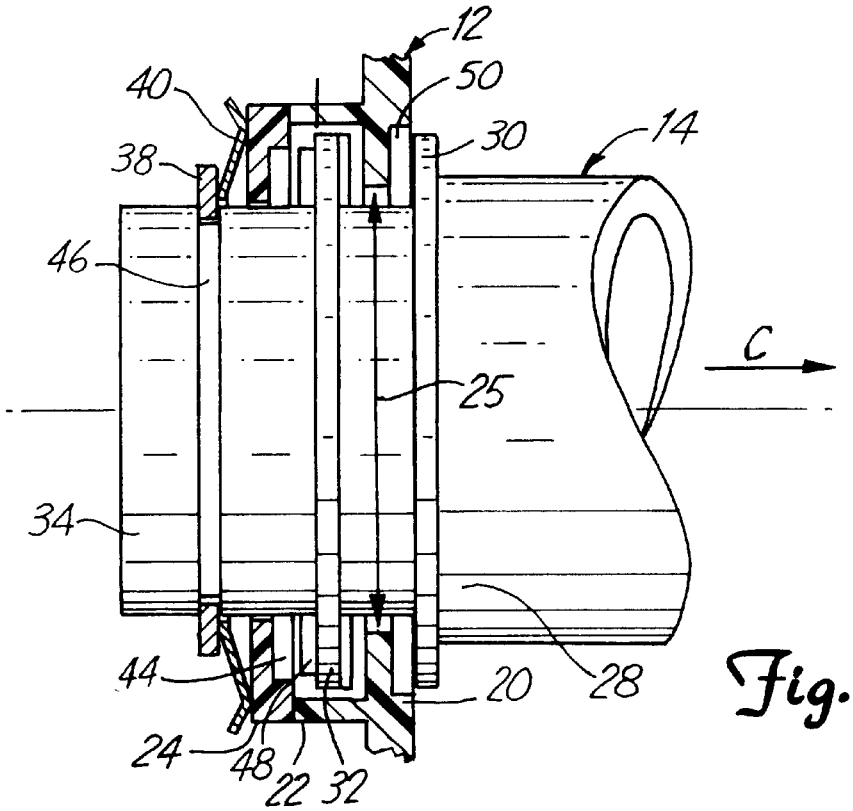
FIG. 8 is a partial cross-sectional view of a preferred embodiment of the invention showing a proximal end of an arm connected to a portion of a base in a flexed state.

In FIG. 8, a partial cross-sectional view of a preferred embodiment of the interconnection between base 12 and arm 14 that is maintained by securing mechanism 18 is shown in a flexed state. In a flexed state, the bias of spring 40 is overcome by exerting a force on arm 14 in the direction of arrow C. The force causes arm 14 to be partially withdrawn from base 12 and separates first flange 30, second flange 32 and protrusions 48 from recess 50, plate 24 and notches 44, respectively. Once protrusions 48 are separated from notches 44, arm 14 can be rotated with respect to base 12 about the longitudinal axis of arm 14 redirecting light from light fixture 10 as shown in FIGS. 2 and 3.

Figure 9:
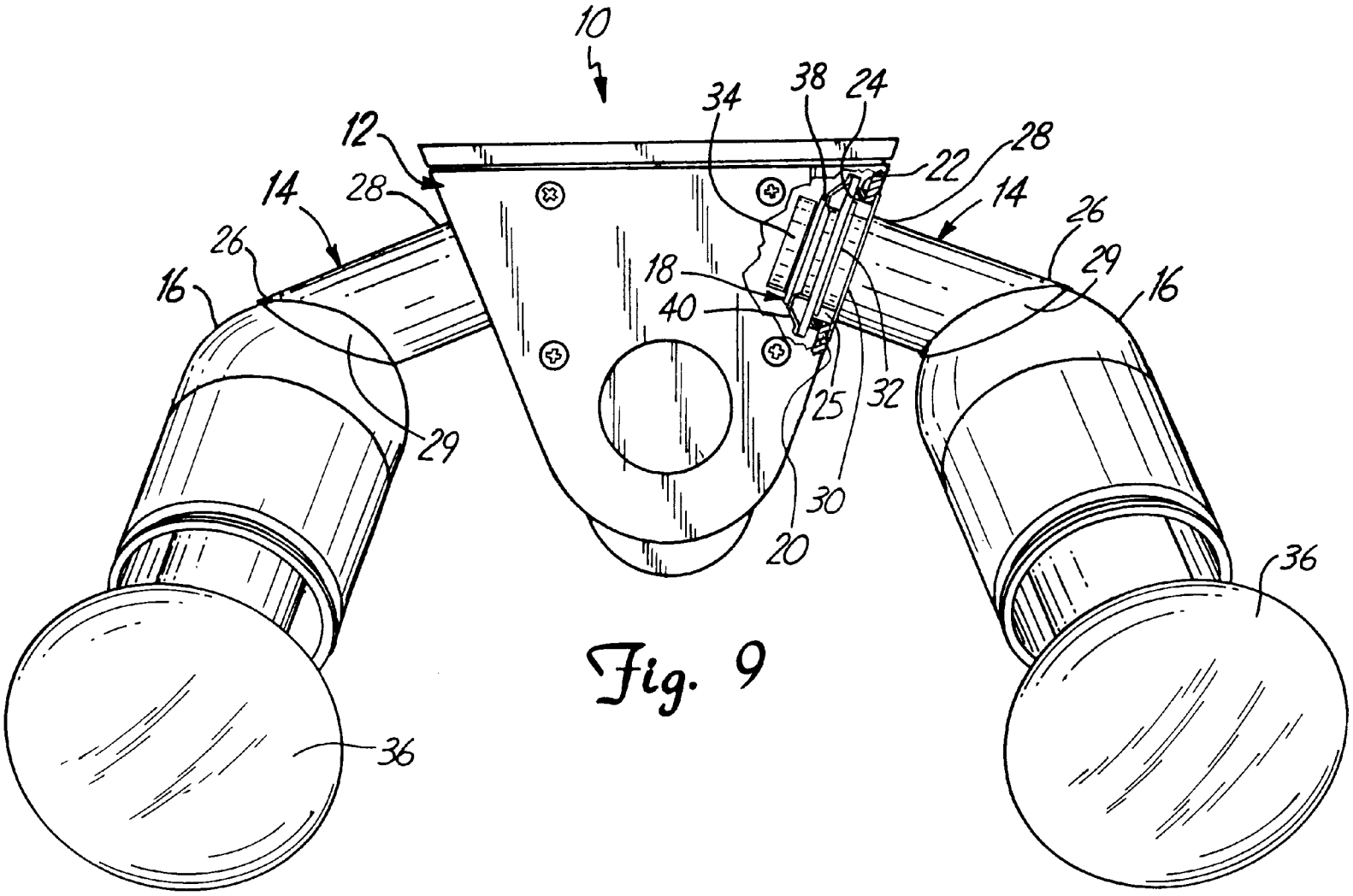
FIG. 9.is a top perspective view with a partial cutaway of a preferred embodiment of the claimed invention.

In FIG. 9, a top partial cutaway view of light fixture 10 shows the interconnection between base 12 and right arm 14 in an unflexed state. Axle 34 of arm 14 is shown cradled in through hole 25 with the outer edge of plate 24 secured against inner wall 22. Plate 24 could be permanently secured to inner wall 22 of base 12, but is preferably separable from base 12 to simplify manufacture and repair.

Spring 40 contacts plate 24 and compresses against retaining clip 38 that is secured in groove 46. This causes first flange 30 to abut with outer wall 20 of base 12 which acts as a stop to allow only axle 34 of arm 14 to be received inside of base 12. Second flange 32 is positioned along axle 34 in relation to first flange 30 such that when first flange 30 abuts outer wall 20, second flange 32 abuts plate 24. With plate 24 maintaining a constant position against inner wall 22, spring 40 then compresses against retaining clip 38 biasing first flange 30 against outer wall 20 and second flange 32 against plate 24. The bias at the interconnection between base 12 and arm 14 can be overcome allowing rotation of arm 14 with respect to base 12. The interconnection between hood 16 and arm 14 is similar to that between arm 14 and base 12. Thus, a bias between hood 16 and arm 14 can be overcome as well to allow rotation of hood 16 with respect to arm 14.

Figure 10A:
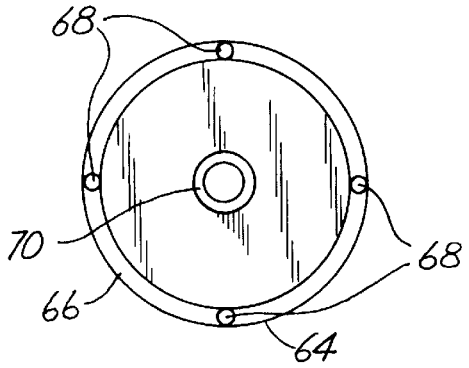
FIG. 10A is an end view of a distal end of an arm.
Figure 10:
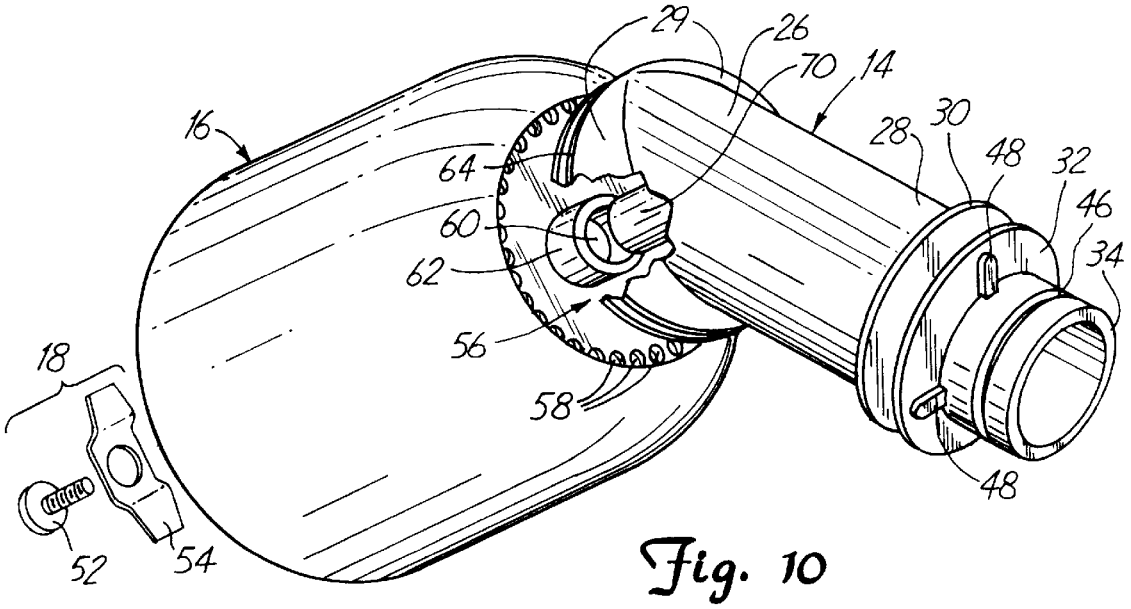
FIG. 10 is an exploded perspective view of the interconnection between a distal end of an arm and a hood of the claimed invention.

In FIG. 10, the interconnection between hood 16 and distal end 26 of arm 14 is shown with securing mechanism 18 in an exploded view. In a preferred embodiment, securing mechanism 18 between hood 16 and arm 14 includes screw 52 and second spring 54. Hood 16 further includes circular depression 56 having a continuous ring of notches 58 around its outer circumference. Centered in depression 56 is aperture 60 which defines the inner circumference of sleeve 62.

In a preferred embodiment, neck 64 extends from circular member 29 at distal end 26 of arm 14. Lip 66 defines the outer edge of neck 64 and is shown in FIG. 10A. A series of protrusions 68 are radially aligned about the annular axis of neck 64 and extend from lip 66. A second axle 70 extends from the center of neck 64 preferably beyond lip 66. The annular axis of second axle 70 and neck 64 is different than the annular axis of the main portion of arm 14. By placing second axle 70 and neck 64 on a different annular axis than the main portion of arm 14, protrusions 68 at distal end 26 and protrusions 68 at proximal end 28 of arm 14 define separate planes that intersect with each other. This helps maximize the variety of directions to which light from fixture 10 can be directed.

The diameter and length of neck 64 is approximately equal to the diameter and length of depression 56. Also, aperture 60 and sleeve 62 are sized to receive second axle 70. Thus, when hood 16 and arm 14 are interconnected, neck 64 is received in depression 56 and second axle 70 is received in sleeve 62 through aperture 60. Notches 58 are then aligned with and receive protrusions 68 when hood 16 and arm 14 are interconnected and form the interconnecting means between arm 14 and hood 16. This creates the generally smooth continuous outer surface at the interconnection between hood 16 and circular member 29, at distal end 26 of arm 14. The generally smooth continuous outer surface helps prevent moisture or debris from building up or entering light fixture 10 at the interconnection of hood 16 and arm 14.

In a preferred embodiment, the series of protrusions 68 are a set of four half spheres placed equidistant about the circumference of lip 66 and the series of notches 58 are a continuous ring of dimples axially aligned with the series of protrusions 68. The use of rounded half spheres and dimples eases the adjustment of hood 16 with respect to arm 14 to redirect light in a desired direction.

The interconnection between hood 16 and arm 14 is maintained by securing means 18. Specifically, the stem of screw 52 passes through a hole in second spring 54 and is then secured into second axle 70. The head of screw 52 retains second spring 54 between the underside of depression 56 and screw 52. In a preferred embodiment, the inner wall of second axle 70 is a threaded insert for receiving screw 52. With screw 52 secured into second axle 70, spring 54 biases depression 56 of hood 16 against lip 66 of arm 14.

Figure 11:
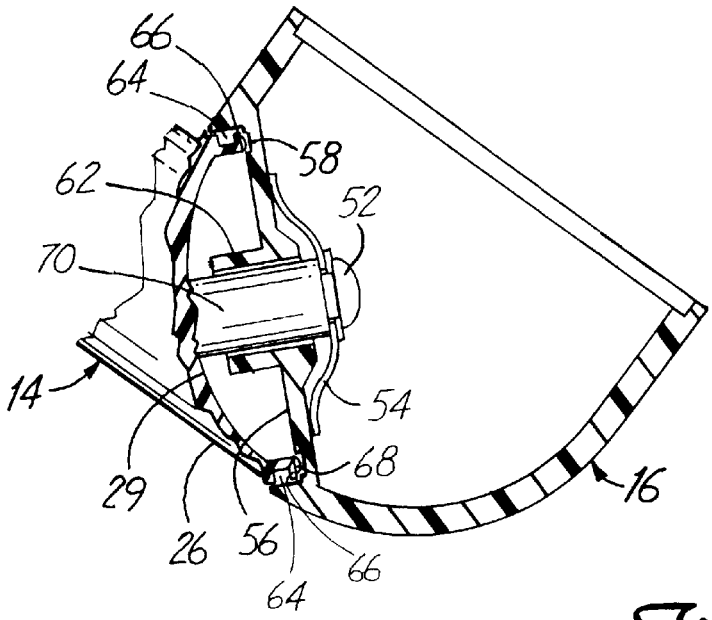
FIG. 11 is a partial cross-sectional view of a preferred embodiment of the invention showing a distal end of an arm connected to a hood in a unflexed state.

FIG. 11 is a partial cross-sectional view showing the interconnection between hood 16 and arm 14 in an unflexed state. Screw 52 is shown secured into second axle 70 which is received by sleeve 62 and extends into the interior of hood 16. This causes spring 54 to bias depression 56 against lip 66. This also biases protrusions 68 into notches 58 preventing rotation of hood 16 with respect to arm 14. As shown in FIG. 11, in an unflexed state neck 64 is received into depression 56 creating a substantially continuous outer surface between hood 16 and circular member 29 at distal end 26 of arm 14.

Figure 12:
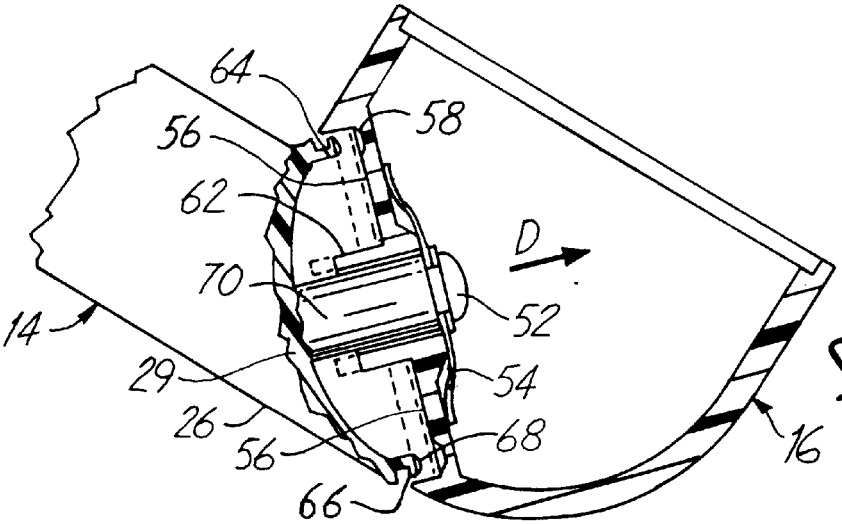
FIG. 12 is a partial cross-sectional view of a preferred embodiment of the invention showing a distal end of an arm connected to a hood in a flexed state.

FIG. 12 is a partial cross-sectional view showing the interconnection between hood 16 and arm 14 in a flexed state. In a flexed state, a force in the direction of arrow D is applied to hood 16 which overcomes the bias of second spring 54 and separates depression 56 and notches 58 from lip 66 and protrusions 68, respectively. The position of hood 16 in an unflexed state is shown in phantom in FIG. 12 to more clearly illustrate the separation created when the interconnection between hood 16 and arm 14 is in a flexed state. Once in a flexed state, hood 16 can be rotated about second axle 70 to change the direction of light provided by light fixture 10. As previously discussed, rotation of hood 16 with respect to arm 14 is shown in FIGS. 4 and 5.

Although the present invention has been described with reference to preferred embodiments, workers skilled in the art will recognize that changes may be made in form and detail without departing from the spirit and scope of the invention. For example, the connection between the base and the arm could be achieved with one flange rather than two. Also, the plate could be permanently secured in the base rather than being separable. The angle that the arms extend from the base could be adjusted as well. The placement of the notches and protrusions could be reversed or a different interconnecting pattern could be used. Additionally, the direction of the bias provided by the springs could be reversed so that an inwardly directed force rather than an outwardly directed force would separate the protrusions from the notches and enable rotation to redirect light provided by the light fixture.

By use of the self-locking, adjustable light fixture, the light provided from a light fixture can easily be directed and maintained to a desired position.

What is claimed is:

1. A self-locking, adjustable light fixture, the fixture comprising:

an arm having an annular shape with a distal end and a proximal end, and having interconnecting means at the distal end and the proximal end;

a base having mating interconnecting means which are axially aligned and mate with the interconnecting means at the proximal end of the arm;

a hood having mating interconnecting means which are axially aligned and mate with the interconnecting means at the distal end of the arm; and a first securing mechanism which connects the base with the proximal end of the arm and a second securing mechanism which connects the hood with the distal end of the arm, such that the interconnecting means and the mating interconnecting means are biased together preventing rotation in an unflexed state that can be overcome by tension which allows rotation of the arm with respect to the base and the hood with respect to the arm in a flexed state.

2. The fixture of claim 1, wherein the interconnecting means at the distal end of the arm defines a first plane and the interconnecting means at the proximal end defines a second plane, such that the first plane and the second plane intersect.

3. The fixture of claim 1, wherein an axle extends from the arm.

4. The fixture of claim 3, wherein the first securing mechanism includes a retaining clip and a spring to connect the base with the axle at the proximal end of the arm, and the second securing mechanism includes a screw and a spring to connect the hood with the axle at the distal end of the arm.

5. The fixture of claim 1, wherein the interconnecting means are a series of protrusions.

6. The fixture of claim 5, wherein the mating interconnecting means are a series of notches that receive the series of protrusions.

7. The fixture of claim 6, wherein the protrusions at the proximal end of the arm and the notches at the base both extend radially outward from an edge having right angles.

8. The fixture of claim 6, wherein the protrusions at the distal end of the arm and the notches at the hood are both formed with rounded corners.

9. The fixture of claim 8, wherein the notches are formed on a plate that is secured by an inner wall of the base.

10. The fixture of claim 8, wherein the notches are formed within a depression that receives and captures the distal end of the arm.

11. A self-locking adjustable light fixture comprising:

an arm of annular shape having a flange, a lip, a pair of axles, a proximal end and a distal end, wherein the axles extend along different axes from the flange at the proximal end and with an inner circumference of the lip at the distal end and a series of protrusions are located on the flange and the lip that are radially aligned about intersecting axes of the arm;

a base having a through hole and a plate, wherein the through hole cradles the proximal end of the arm and the plate has a series of notches that are axially aligned with the protrusions on the flange and are placed in a continuous ring about an opening in the plate that the axle at the proximal end of the arm passes through allowing the protrusions and the notches to mate;

a hood having an aperture centered within a circular depression which has a series of notches that are formed in a continuous ring and are axially aligned with the protrusions on the lip, wherein the aperture receives the axle at the distal end of the arm capturing the lip within the depression and allowing the protrusions and the notches to mate; and a first securing mechanism which connects the plate of the base to the proximal end of the arm, and a second securing mechanism which connects the hood to the distal end of the arm, such that the protrusions and the notches are biased together in an unflexed state but can be separated under tension to allow rotation of the arm and the hood in a flexed state.

12. The fixture of claim 11, wherein the protrusions at the distal end and the notches at the hood are both formed with rounded corners.

13. The fixture of claim 11, wherein the protrusions at the proximal end of the arm and the notches at the base both extend radially outward from an edge having right angles.

14. The fixture of claim 11, wherein the first securing mechanism comprises a retaining clip and a spring between the base and the proximal end of the arm, and the second securing mechanism comprises a screw and a spring between the hood and the distal end of the arm.

15. A method to adjust the direction of light using a self-locking, adjustable light fixture, the method including:

applying tension at a connection point between a hood and a distal end of an arm to overcome a bias of a hood securing mechanism so that mating interconnecting means located on the hood are separated from interconnecting means located on the distal end of the arm;

rotating the hood to aim the light;

releasing the hood so that the hood securing mechanism biases the interconnecting means on the distal end of the arm into the mating interconnecting means on the hood causing them to mate and maintain the desired direction of light;

applying tension at a connection point between a proximal end of the arm and a base, such that an arm securing mechanism bias is overcome and interconnecting means located on the proximal end of the arm are separated from mating interconnecting means located on the base;

rotating the arm to aim the light in a desired direction; and releasing the proximal end of the arm so that the arm securing mechanism biases the interconnecting means on the proximal end of the arm into the mating interconnecting means on the base causing them to mate and maintain the desired direction of light.

16. The method of claim 15, wherein the interconnecting means comprise a series of protrusions and the mating interconnecting means comprise a series of notches.

* * * * *